US012139685B1

(12) United States Patent
Price et al.

(10) Patent No.: US 12,139,685 B1
(45) Date of Patent: Nov. 12, 2024

(54) FIRE-STARTING MATERIAL

(71) Applicant: Isaiah W. Price, Spanish Fork, UT (US)

(72) Inventors: Isaiah W. Price, Spanish Fork, UT (US); Joshua L Erickson, Lehi, UT (US)

(73) Assignee: Isaiah W. Price, Spanish Fork, UT (US)

( * ) Notice: Subject to any disclaimer, the term of this patent is extended or adjusted under 35 U.S.C. 154(b) by 0 days.

(21) Appl. No.: 18/142,998

(22) Filed: May 3, 2023

Related U.S. Application Data

(60) Provisional application No. 63/337,985, filed on May 3, 2022.

(51) Int. Cl.
*C10L 5/14* (2006.01)
*C10L 5/44* (2006.01)

(52) U.S. Cl.
CPC ..... *C10L 5/146* (2013.01); *C10L 5/44* (2013.01); *C10L 2200/0213* (2013.01); *C10L 2200/0254* (2013.01); *C10L 2200/029* (2013.01); *C10L 2230/22* (2013.01); *C10L 2290/28* (2013.01); *C10L 2290/32* (2013.01); *C10L 2300/40* (2013.01)

(58) Field of Classification Search
CPC .... C10L 5/146; C10L 5/44; C10L 2200/0213; C10L 2200/0254; C10L 2200/029; C10L 2230/22; C10L 2290/28; C10L 2290/32; C10L 2300/40
See application file for complete search history.

(56) References Cited

U.S. PATENT DOCUMENTS 3,414,443 A * 12/1968 Pheasant ..... C06C 15/00 149/20
2018/0148659 A1* 5/2018 Mathews ..... C10L 11/06

FOREIGN PATENT DOCUMENTS

JP H04254112 A * 1/1992
KR 20090018735 A * 2/2009

OTHER PUBLICATIONS

Pyro Putty Sportsman's Warehouse Review—Dan Kidder Highlights, https://www.youtube.com/watch?v=RF_iFhSZUBk, Published Jul. 1, 2019.
Pyro Putty Waterproof Fire Starter—Winter Blue Blend, https://pyroputty.com/product/waterproof-fire-starter-winter-blue-blend/ Accessed Nov. 1, 2023.

* cited by examiner

*Primary Examiner* — Latosha Hines
(74) *Attorney, Agent, or Firm* — Young Basile Hanlon & MacFarlane, P.C.

(57) ABSTRACT

A fire-starting material is disclosed. The fire-starting material may include metal powder, fibers, oxidizers, other powdered fuels, and a binder. The binder may be a hydrocarbon or a combination of hydrocarbons made up of molecules with about 10 to about 80 carbon atoms. The binder may hold the metal powder and the fibers in suspension. Additionally, the binder (and hence the fire-starting material overall) may be manually pliable between about −5 and about 50 degrees Celsius. To use the fire-starting material, a user may manually deform the fire-starting material to tear off a piece thereof. The piece may be applied to a fuel source and lit on fire.

20 Claims, 2 Drawing Sheets

FIRE-STARTING MATERIAL

CROSS-REFERENCE TO RELATED APPLICATION(S)

This application claims priority to and the benefit of U.S. Provisional Patent Application Ser. No. 63/337,985, filed May 3, 2022, the entire disclosure of which is hereby incorporated by reference.

TECHNICAL FIELD

This disclosure relates to compounds and, more particularly, to novel systems and methods for fire-starting material.

BACKGROUND

When participating in certain outdoor activities, it may be beneficial to start a fire. Accordingly, what is needed are systems and methods that facilitate starting a fire.

SUMMARY

Disclosed herein are implementations of a fire-starting material. The fire-starting material may comprise metal powders and other flammable powders, oxidizers, fibers, and binders (e.g., a binder or combination of binders that act both as a binder and a plasticizer). The binder may comprise a hydrocarbon or a combination of hydrocarbons made up of molecules with about 10 to about 80 carbon atoms. The binder may hold the fibers and other ingredients in suspension. Additionally, the binder (and hence the fire-starting material overall) may be manually pliable through a range of temperatures (e.g., between about −5 and about 50 degrees Celsius).

The metal powder may comprise zinc or the like. In selected embodiments, the metal powder may form about 1 to about 10 percent by weight of the fire-starting material.

The fibers may comprise synthetic or natural substances such as cotton or the like. In certain embodiments, the fibers may form about 1 to about 10 percent by weight of the fire-starting material.

The binder may comprise aliphatic or aromatic hydrocarbons such as paraffin or polyisobutylene, polystyrene or other organic or inorganic polymeric compounds or the like or a combination or sub-combination thereof. For example, in selected embodiments, the binder may comprise petroleum jelly forming about 5 to about 25 percent by weight of the fire-starting material, polyisobutylene forming about 2 to about 10 percent by weight of the fire-starting material, and paraffin forming about 4 to about 15 percent by weight of the fire-starting material.

The fire-starting material may include an oxidizer. The oxidizer may comprise chlorate salts, perchlorate salts, nitrate salts, or combinations thereof. In certain embodiments, the oxidizer may comprise a perchlorate salt (e.g., calcium perchlorate) forming about 25 to about 40 percent by weight of the fire-starting material and a nitrate salt (e.g., strontium nitrate) forming about 5 to about 20 percent by weight of the fire-starting material.

The fire-starting material may comprise a carbohydrate. The carbohydrate may form about 5 to about 20 percent by weight of the fire-starting material. In certain embodiments, the carbohydrate may comprise potato starch or the like.

The fire-starting material may comprise trioxane. The trioxane may form about 1 to about 10 percent by weight of the fire-starting material.

To use the fire-starting material, a user may obtain a quantity of the fire-starting material and manually deform it to tear off a portion thereof. The portion may be applied to a fuel source and lit on fire. Applying the portion to the fuel source may include manually molding the portion onto the fuel source. For example, a user may manually wrap the portion at least partially around the fuel source or some piece of the fuel source.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
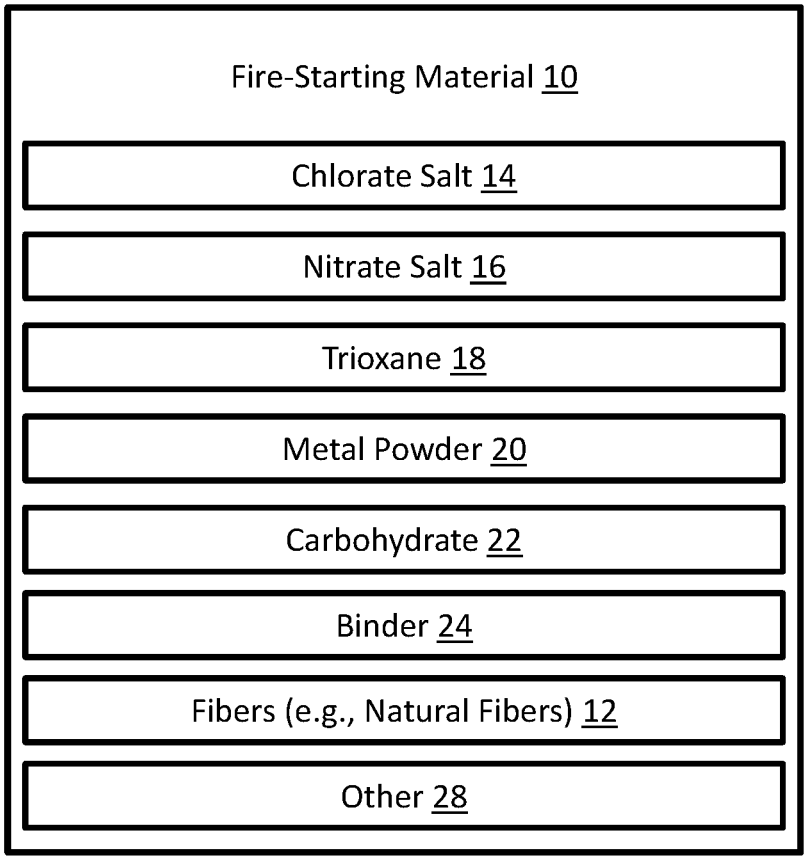
FIG. 1 is a block diagram of one embodiment of a fire-starting material.

Referring to FIG. 1, in selected embodiments, a fire-starting material 10 may be a clay-like (i.e., pliable, capable of being manually molded or shaped). Alternatively, or in addition thereto, a fire-starting material 10 may be fibrous or include certain fibers 12 embedded therewithin. Fire-starting material 10 may be carried and/or used in various outdoor activities such as camping, hiking, backpacking, hunting, and bushcrafting. In selected embodiments, the fire-starting material 10 may be included as part of an outdoor cook kit or meal kit. Alternatively, or in addition thereto, the fire-starting material 10 may be used in survival situations and/or be included within survival kits or the like. In still other embodiments, the fire-starting material 10 may be included as part of a material or document destruction kit (e.g., a kit for use in destroying sensitive or classified documents or materials in a military activity, environment, or the like). The fire-starting material 10 may be described as a composition with a dispersion of components that is random or relatively uniform.

The fire-starting material 10 may be resistant to wind such that the fire-starting material 10 is ignitable in adverse conditions (e.g., windy conditions, wet or damp conditions, or the like). In certain embodiments, the fire-starting material 10 may burn at a temperature of about 700 degrees Celsius (C), about 800° C. or more, about 900° C. or more, or about 1000° C. or more. In selected embodiments, fibers 12 within the fire-starting material 10 may function to initiate a flame or ember in or on the fire-starting material 10. Such fibers 12 may conduct or hold a flame or ember long enough for one or more other compounds or components of the fire-starting material 10 to catch fire (e.g., volatize flammable gases) and provide the desired length and strength of the burn.

The fibers 12 may include any material sufficient to initiate or hold an ember or flame on or in the fire-starting material 10. For example, the fibers 12 may include flammable organic and/or inorganic fibers. The fibers 12 may include flammable natural and/or synthetic fibers. The fibers 12 may include seed, leaf, bast, fruit, and/or stalk fibers. Alternatively, or in addition thereto, the fibers 12 may include one or more of cotton, wood, hemp, flax, corn, grass, jute, or any combination thereof.

The fibers 12 may be arranged within the composition such that flammability is increased. For example, the fibers 12 may be arranged (e.g., agglomerated or matted in multiple sections of the fire-starting material 10) such that a flame is held longer within the fire-starting material 10. In other examples, individual fibers 12 may be mixed or dispersed within the fire-starting material 10 so that the fibers 12 may initiate or hold a flame in combination with other components described herewith.

The fire-starting material 10 may be waterproof or substantially waterproof. For example, the fire-starting material 10 may resist absorbing water or may resist degrading in performance or consistency in the presence of water (e.g., in the rain, in snow, when submerged in water, in humid environments, or the like). To benefit from the fire-starting material 10, a user may simply tear off a portion of the fire-starting material 10, expose certain fibers 12 of the fire-starting material 10, light the fire-starting material 10 (e.g., light the fibers 12, which may then light the rest of the fire-starting material 10) with a lighter, ferro rod, match, or the like, and then use the hot, durable, and lengthy burn of the fire-starting material 10 to light other materials (e.g., some other fuel source such as wood, larger pieces of wood, damp wood) that are more difficult to light directly and/or that may burn much longer than the fire-starting material 10.

In certain embodiments, tearing off a portion of the fire-starting material 10 may involve manually deforming (e.g., stretching, pinching, or the like) the fire-starting material 10. It may further involve exposing certain fibers 12 and no other effort toward exposing fibers 12 (e.g., exposing additional fibers 12) may be needed. Applying the portion to the fuel source may include manually molding the portion onto the fuel source. For example, a user may manually deform and wrap the portion at least partially around the fuel source or some piece thereof.

In selected embodiments, a fire-starting material 10 in accordance with the present invention may comprise chlorate salt 14, nitrate salt 16, trioxane 18, metal powder 20, carbohydrate 22, a binder 24, fiber 12, one or more other components 28, derivatives thereof, residues thereof, or any combination or sub-combination thereof.

In certain embodiments, chlorate salt 14 may act as an oxidizer during combustion of the fire-starting material 10. The chlorate salt may include chlorate and/or perchlorate anion and cation components such that a salt is formed. The cation component may comprise one or more of an alkali metal, alkaline earth metal, transition metal, ammonium (or primary, secondary, tertiary, or quaternary ammonium ions), hydrogen, or any combination thereof. The chlorate or perchlorate portion of the chlorate salt may be a derivative or residue of perchloric or chloric acid. The chlorate salt may comprise one or more of sodium chlorate, potassium chlorate, barium chlorate, calcium chlorate, ammonium chlorate, ammonium perchlorate, potassium perchlorate, sodium perchlorate, or the like or a combination or sub-combination thereof.

In certain embodiments, nitrate salt 16 may act as an oxidizer during combustion of the fire-starting material 10. The nitrate salt may include a nitrate having an anionic portion and a counterion. The counterion may include one or more alkali metals, alkaline earth metals, transition metals, ammonium (or primary, secondary, tertiary, or quaternary ammonium ions), hydrogen, or any combination thereof. The nitrate portion of the nitrate salt may be a derivative or residue of nitric acid. The nitrate salt may include one or more of sodium nitrate, potassium nitrate, barium nitrate, calcium nitrate, ammonium nitrate, strontium nitrate, or the like or a combination or sub-combination thereof.

In selected embodiments, chlorate salts 14 may be more rapid oxidizers than nitrate salts 16. Accordingly, chlorate salts 14 may enable or support a hotter and faster burn, while nitrate salts 16 may enable or support a slower (and therefore longer) burn. By including both chlorate salt 14 and nitrate salt 16, the fire-starting material 10 may have or exhibit both a rapid ignition and an extended burn.

In certain embodiments, trioxane 18 may be added as a solid flammable material that volatizes at relatively low temperatures. As a result, trioxane 18 may support a relatively large flame as the volatized material or materials therefrom billow up and are burned. In selected embodiments, trioxane 18 may be replaced or substituted or combined with other flammable heterocyclic organic compounds. The heterocyclic organic compounds may include one or more hetero atoms, such as nitrogen, sulfur, and/or oxygen, that are bound to one or more carbon atoms in the cyclic ring. Examples of heterocyclic organic compounds may include trioxane, hexamine, or a combination of both.

In certain embodiments, metal powder 20 may be a fuel that increases the burn temperature of the fire-starting material 10. For example, the metal powder 20 may interact with oxygen produced by the chlorate salt 14 and/or nitrate salt 16 or from the surrounding environment to enable the fire-starting material 10 to burn hotter and perform better (e.g., have better fire-starting abilities) in adverse conditions (e.g., adverse weather conditions). The metal powder 20 may include a pure metal or an alloy. The metal powder 20 may include zinc powder, aluminum powder, magnalium powder, magnesium powder, or the like or a combination or sub-combination thereof.

In certain embodiments, a carbohydrate 22 may be considered a heterocyclic organic compound and may provide similar benefits to the trioxane 18 described above. For example, carbohydrate 22 may support a relatively large, billowing flame. Moreover, in combination with chlorate salt 14, the carbohydrate 22 may result in a fire-starting material 10 that is easily ignited. The carbohydrate 22 may include sucrose, corn starch, potato starch, glucose, fructose, lactose, or other simple or complex carbohydrates, or the like or a combination or sub-combination thereof.

The binder 24 may hold the fire-starting material 10 together. The binder may also provide and preserve a desired plasticity, pliability, or the like of the fire-starting material 10. The binder 24 (or a selected portion of the binder 24) may impart certain water resistant or waterproof characteristics to the fire-starting material 10. That is, the binder 24 may resist the absorption of water or may resist degradation in performance or consistency in the presence of water. Additionally, the binder 24 may provide a portion of the fuel within the fire-starting material 10. In selected embodiments, the binder 24 may include petroleum jelly, paraffin, mineral oil, glue, or the like or a combination or sub-combination thereof. Accordingly, the binder 24 may be or include a hydrocarbon or a combination of hydrocarbons made up of molecules with about 10 to about 80 carbon atoms.

Glue that forms part of a binder 24 may comprise polyisobutylene. The glue may be a sticky substance that holds the solids (e.g., metal powders 20, fibers 12, etc.) in suspension. Also, the glue may provide a portion of the fuel within the fire-starting material 10. In certain embodiments, the glue may be replaced or substituted with other rubbers or polymers such as latex, neoprene, PVC, acrylic, silicone or the like or a combination or sub-combination thereof.

The fibers 12 may enable or support quick ignition, provide structure that cooperates with the binder 24 to hold the fire-starting material 10 together, act as a wick (e.g., hold a flame that consumes material volatized from adjacent portions of the fire-starting material 10), and form a portion of the fuel of the fire-starting material 10. The fibers 12 may be or comprise cotton (e.g., cellulose). In certain embodiments, the fibers 12 in the form of cotton may be replaced or substituted with other cellulose structures or natural fibers such as hemp, jute, wool, flax, bamboo, or the like or a combination or sub-combination thereof.

The fire-starting material 10 may be formed by mixing the various dry or powdered components, heating and mixing the various liquid or meltable components (e.g., petroleum jelly, paraffin, mineral oil, glue, or the like or a combination or sub-combination thereof), and then mixing the dry or powdered components with the liquid or meltable components and the fiber 12. Once fully combined and cooled, the resulting fire-starting material 10 may be manually pliable, capable of being manually torn or cut into pieces, and capable of maintaining such pliability even when left uncovered or unpackaged for days, weeks, months, or even years.

Figure 2:
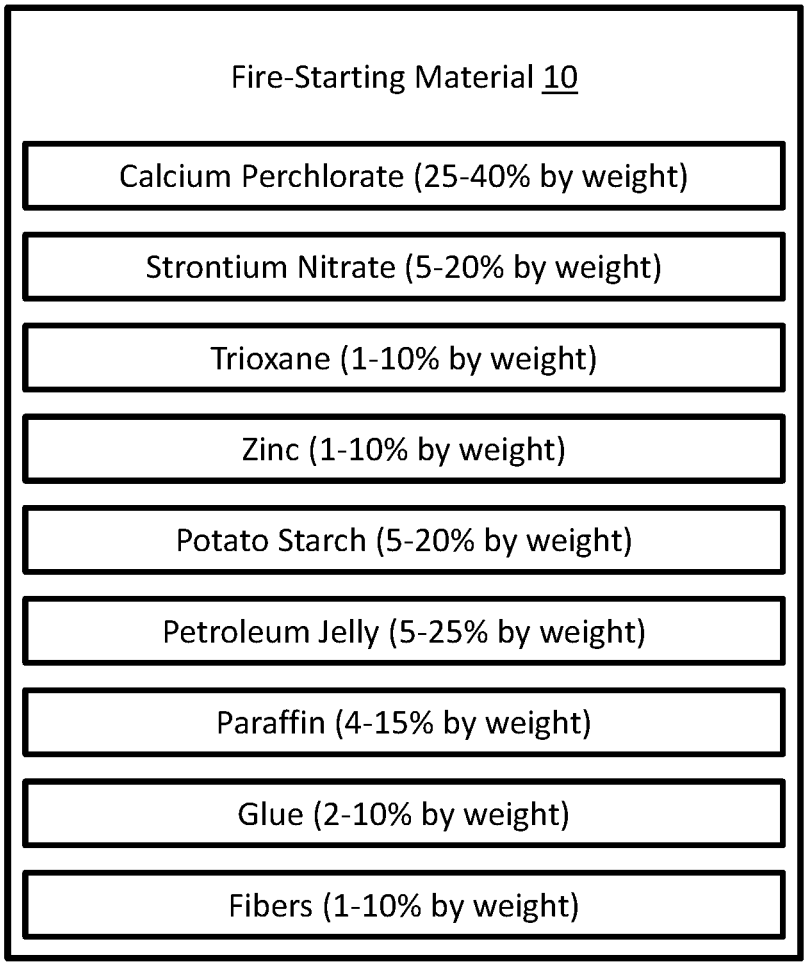
FIG. 2 is a block diagram of an alternative embodiment of a fire-starting material.

Referring to FIG. 2, in selected embodiments, a fire-starting material 10 may comprise calcium perchlorate, strontium nitrate, trioxane, zinc, potato starch, petroleum jelly and/or paraffin, glue, fiber 12, one or more other components 28, or the like or a combination or sub-combination thereof in the weigh percentages provided. Alternatively, a fire-starting material 10 may comprise a formulation as set forth in FIG. 2 but with one or more of the illustrated components omitted or replaced (e.g., replaced in the weight percentages provided) by one or more of the substitutes or alternatives discussed in connection with FIG. 1.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A fire-starting material comprising:
- metal powder forming about 1 to about 10 percent by weight of the fire-starting material;
- fibers;
- a binder comprising a hydrocarbon or a combination of hydrocarbons made up of molecules with about 10 to about 80 carbon atoms; and
- the binder holding the metal powder and the fibers in suspension and being manually pliable between about −5 and about 50 degrees Celsius.

2. The fire-starting material of claim 1, further comprising an oxidizer selected from the group consisting of chlorate salt and nitrate salt.

3. The fire-starting material of claim 1, wherein the binder comprises a material selected from the group consisting of petroleum jelly, mineral oil, polyisobutylene.

4. The fire-starting material of claim 1, wherein the fibers comprise cotton.

5. The fire-starting material of claim 4, wherein the fibers form about 1 to about 10 percent by weight of the fire-starting material.

6. The fire-starting material of claim 2, further comprising an oxidizer including chlorate salt and nitrate salt.

7. The fire-starting material of claim 6, wherein the oxidizer comprises:
- chlorate salt forming about 25 to about 40 percent by weight of the fire-starting material; and
- nitrate salt forming about 5 to about 20 percent by weight of the fire-starting material.

8. The fire-starting material of claim 3, wherein the binder comprises petroleum jelly forming about 5 to about 25 percent by weight of the fire-starting material.

9. The fire-starting material of claim 3, wherein the binder comprises polyisobutylene forming about 2 to about 10 percent by weight of the fire-starting material.

10. The fire-starting material of claim 3, wherein the binder comprises paraffin forming about 4 to about 15 percent by weight of the fire-starting material.

11. The fire-starting material of claim 1, wherein the metal powder comprises zinc forming about 1 to about 10 percent by weight of the fire-starting material.

12. The fire-starting material of claim 1, further comprising a carbohydrate.

13. The fire-starting material of claim 12, wherein the carbohydrate forms about 5 to about 20 percent by weight of the fire-starting material.

14. The fire-starting material of claim 13, wherein the carbohydrate comprises potato starch.

15. The fire-starting material of claim 1, further comprising trioxane.

16. The fire-starting material of claim 15, wherein the trioxane forms about 1 to about 10 percent by weight of the fire-starting material.

17. A method for starting a fire, the method comprising:
- obtaining a fire-starting material comprising
  - metal powder,
  - fibers,
  - a binder comprising paraffin forming about 4 to about 15 percent by weight of the fire-starting material, and
  - the binder holding the metal powder and the fibers in suspension and being manually pliable between about −5 and about 50 degrees Celsius;
- manually deforming the fire-starting material;
- tearing off, during the deforming, a portion of the fire-starting material;
- applying the portion to a fuel source; and
- lighting the portion on fire.

18. The method of claim 17, wherein the applying comprises manually molding the portion onto the fuel source.

19. The method of claim 18, wherein the molding comprises manually wrapping the portion at least partially around the fuel source.

20. The method of claim 17, wherein the metal powder forms about 1 to about 10 percent by weight of the fire-starting material.

* * * * *